US011304876B1

(12) United States Patent
Zhang

(10) Patent No.: US 11,304,876 B1
(45) Date of Patent: Apr. 19, 2022

(54) NURSING BOTTLE

(71) Applicant: THINK GREEN LIMITED, Auckland (NZ)

(72) Inventor: Shu Ting Zhang, Jingshan (CN)

(73) Assignee: THINK GREEN LIMITED, Rosedale (NZ)

( * ) Notice: Subject to any disclaimer, the term of this patent is extended or adjusted under 35 U.S.C. 154(b) by 0 days.

(21) Appl. No.: 17/495,490

(22) Filed: Oct. 6, 2021

Related U.S. Application Data

(63) Continuation of application No. 17/351,892, filed on Jun. 18, 2021.

(30) Foreign Application Priority Data

Feb. 9, 2021 (CN) ..... 202110182076.0

(51) Int. Cl.
*A61J 9/06* (2006.01)

(52) U.S. Cl.
CPC ..... *A61J 9/0607* (2015.05); *A61J 9/0653* (2015.05)

(58) Field of Classification Search
CPC ..... A61J 9/0607; A61J 9/0653; A61J 11/045
See application file for complete search history.

(56) References Cited

U.S. PATENT DOCUMENTS 1,987,132 A * 1/1935 Shine ..... A61J 9/0607 248/104
5,086,517 A * 2/1992 Jones ..... A61J 9/00 2/104
5,690,679 A 11/1997 Prentiss
5,791,503 A * 8/1998 Lyons ..... A61J 11/002 215/11.5
6,112,919 A * 9/2000 Ho ..... A61J 11/002 215/11.1
6,681,944 B1 * 1/2004 Youssef ..... A61J 9/005 215/11.1

(Continued)

FOREIGN PATENT DOCUMENTS

CN 102379814 3/2012
CN 211096158 7/2020

(Continued)

OTHER PUBLICATIONS

PCT/CN2021/089798 International Search Report and Written Opinion dated Nov. 3, 2021.

*Primary Examiner* — Amy J. Sterling
(74) *Attorney, Agent, or Firm* — Michael Best & Friedrich LLP

(57) ABSTRACT

Provided is a nursing bottle. The nursing bottle includes a bottle body and a bottle bottom. The bottle body is detachably connected to the bottle bottom. Both the bottle body and the bottle bottom are made of silica gel, and the bottle body has an arc shape imitating a woman's breast. An outer side of the bottle body is provided with a nipple. The nipple is provided with a water outlet. The bottle body is provided with a containing cavity and a first opening. A storage bin for storing liquid is provided in the containing cavity. The water outlet is in communication with the storage bin. A side of the storage bin facing towards the bottle bottom is provided with a second opening. Reinforcing ribs are provided between the cavity wall of the containing cavity and the outer periphery of the storage bin.

19 Claims, 6 Drawing Sheets

(56) References Cited

U.S. PATENT DOCUMENTS

| | | | | |
|---|---|---|---|---|
| 7,044,316 | B1 * | 5/2006 | Hsu | A61J 9/006 215/11.1 |
| 8,684,201 | B2 * | 4/2014 | Berkovitch | A61J 9/04 215/11.5 |
| 9,060,917 | B1 * | 6/2015 | Tronson | A61J 9/0607 |
| 10,028,891 | B2 * | 7/2018 | Luo | A61J 9/006 |
| 10,058,481 | B1 * | 8/2018 | Russo | B65D 51/00 |
| 10,973,738 | B1 * | 4/2021 | Tronson | A61J 9/0676 |
| 11,076,969 | B2 * | 8/2021 | Meikle | A61J 9/0676 |
| 11,097,876 | B2 * | 8/2021 | Chalermwinsuekun | B65D 51/18 |
| 2006/0157065 | A1 | 7/2006 | Rohrig | |
| 2007/0163983 | A1 * | 7/2007 | Hsu | A61J 11/002 215/11.1 |
| 2012/0234788 | A1 * | 9/2012 | Livingston | A61J 9/00 215/11.6 |
| 2013/0048671 | A1 * | 2/2013 | Braly | A45F 3/20 222/129 |
| 2015/0335533 | A1 * | 11/2015 | Pineda | A61J 9/00 215/11.1 |
| 2020/0060940 | A1 * | 2/2020 | Conneely | A41C 3/04 |
| 2021/0361533 | A1 * | 11/2021 | Pineda | A61J 11/002 |

FOREIGN PATENT DOCUMENTS

| | | |
|---|---|---|
| CN | 111671652 | 9/2020 |
| CN | 211835413 | 11/2020 |

* cited by examiner

NURSING BOTTLE

CROSS-REFERENCE TO RELATED APPLICATION(S)

This application is a continuation of U.S. patent application Ser. No. 17/351,892 filed Jun. 18, 2021 which claims priority to Chinese Patent Application No. 202110182076.0 filed Feb. 9, 2021, the disclosure of which is incorporated herein by reference in its entirety.

TECHNICAL FIELD

The present disclosure relates to the technical field of a nursing bottle, and, in particular, to a nursing bottle imitating a woman's breast.

BACKGROUND

In the process of transition from breastfeeding to formula milk feeding for infants and young children, parents generally use nursing bottles for transition feeding of infants and young children. Since infants and young children have adapted to the skin feel, breast shape, and nipple biting of the mother's breasts in the early stage, most of the current bionic structure nursing bottles are only similar to the shape of female breasts in appearance, but difficult to be felt similar to the human body from the sense of touch. Therefore, during the transitional feeding period of using the nursing bottle, infants and young children are prone to rejecting the nursing bottles, and even refuse to accept nursing bottles and do not to eat. It can easily cause malnutrition and affect infants and young children's growth that the infants and young children in the early stages of growth are insufficiently fed.

SUMMARY

The present disclosure provides a nursing bottle whose shape and sense of touch is similar to a woman's breast and not easy to collapse.

Provided is a nursing bottle. The nursing bottle includes a bottle body and a bottle bottom, and the bottle body is detachably connected to the bottle bottom.

Both the bottle body and the bottle bottom are made of silica gel, and the bottle body has an arc shape imitating a woman's breast.

An outer side of the bottle body is provided with a nipple, and the nipple is provided with a water outlet.

the bottle body is provided with a first opening, and the first opening is selectively blocked by the bottle bottom.

A containing cavity is provided in the bottle body, a storage bin for storing liquid is provided in the containing cavity, and the water outlet is in communication with the storage bin.

A side of the storage bin facing towards the bottle bottom is provided with a second opening.

Reinforcing ribs are provided between the cavity wall of the containing cavity and the outer periphery of the storage bin.

In an embodiment, an outer surface of the bottle body is smooth.

In an embodiment, an outer surface of a connection position of the bottle body and the bottle bottom is flush, in the case where the bottle body is connected to the bottle bottom.

In an embodiment, a cross-sectional size of the storage bin gradually decreases in a direction from the second opening to the water outlet. The storage bin is inclined downward in the case where the nursing bottle is in use, one end of the storage bin provided with the water outlet is lower than another end of the storage bin facing towards the first opening, and the storage bin is at an angle $\alpha$ to a horizontal.

In an embodiment, the angle $\alpha$ is in a range of 8° to 25°.

In an embodiment, an inner wall of the storage bin is smooth.

In an embodiment, the storage bin is provided with a seal that blocks the second opening, and the seal is detachably connected to the storage bin.

In an embodiment, a first handle is provided on a side of the seal facing towards the bottle bottom.

In an embodiment, a second handle is provided on the bottle body.

In an embodiment, a suction cup is provided on a side of the bottle bottom facing away from the bottle body, and the suction cup is detachably connected to the bottle bottom.

In an embodiment, the nursing bottle further comprises a protective cover, the protective cover is detachably connected to the bottle body, and the protective cover is provided outer side of the nipple.

In an embodiment, a ring shaped convex strip is provided on a position on an inner wall of the protective cover adjacent to the nipple. The convex strip is capable of clamping the nipple tightly in case where the protective cover is connected to the bottle body.

In an embodiment, the nipple is detachably connected to the bottle body, and an outer surface of the nursing bottle is smooth in case where the nipple is connected to the bottle body.

In an embodiment, the nursing bottle further comprises a first fixing ring and a second fixing ring cooperated with each other, and the bottle body is connected to the bottle bottom by the first fixing ring and the second fixing ring.

The first fixing ring is connected to the first opening of the bottle body, and the second fixing ring is connected to the bottle bottom.

The first fixing ring is detachably connected to the second fixing ring, and the hardness of the first fixing ring and the second fixing ring is greater than that of the bottle body and the bottle bottom.

The first fixing ring and the second fixing ring are hidden inside the nursing bottle in a case where the bottle body is connected to the bottle bottom.

In an embodiment, the first opening is provided with a first installation groove, and the first fixing ring is provided in the first installation groove; the bottle bottom is provided with a second installation groove, and the second fixing ring is provided in the second installation groove.

In an embodiment, at least one of the following configurations is adopted: the first fixing ring is fixed to the bottle body with glue; or the second fixing ring is fixed to the bottle bottom with glue.

In an embodiment, the first fixing ring is connected to the second fixing ring by threads, one of the first fixing ring and the second fixing ring is provided with an external thread, and another of the first fixing ring and the second fixing ring is provided with a internal thread matched with the external thread.

In an embodiment, both a connection between the bottle body and the bottle bottom and a connection between the first fixing ring and the second fixing ring are in a snap-fit manner.

The first fixing ring is connected to the second fixing ring by at least two sets of first buckling components, each set of the first buckling components includes a first buckle and a first slot.

The first fixing ring is provided with at least one first buckle and at least one first slot at intervals among the at least two sets of first buckling components, the second fixing ring is correspondingly provided with at least one first slot and at least one first buckle respectively among the at least two sets of first buckling components.

The lengths of the first buckle and the first slot are configured to extend along a first direction.

At least two sets of second buckling components are provided between the bottle body and the bottle bottom, each set of the second buckling components includes a second buckle and a second slot.

The bottle body is provided with at least one second buckle and at least one second slot at intervals among the at least two sets of second buckling components, the bottle bottom is correspondingly provided with at least one second slot and at least one second buckle among the at least two sets of second buckling components.

The lengths of the second buckle and the second slot are along a second direction.

The first direction is at an angle to the second direction.

The bottle body has an arc shape imitating woman's breast, which enables infants and young children to gradually adapt to the way of bottle feeding. Since the bottle body is made of silica gel, and the hardness of the bottle body is small, it is easy to deform the bottle during holding the bottle by hand. The reinforcing ribs are provided between the storage bin and the accommodating cavity, when there is less liquid in the storage bin, the reinforcing ribs can provide support for the bottle body, so that the bottle body is kept in an arc shape to avoid the rejection of infants and young children due to the deformation of the nursing bottle and it is convenient for feeders to feed infants and young children.

BRIEF DESCRIPTION OF DRAWINGS

The present disclosure will be further described in detail based on the drawings and embodiments below.

DESCRIPTION OF REFERENCE NUMERALS

Figure 1:
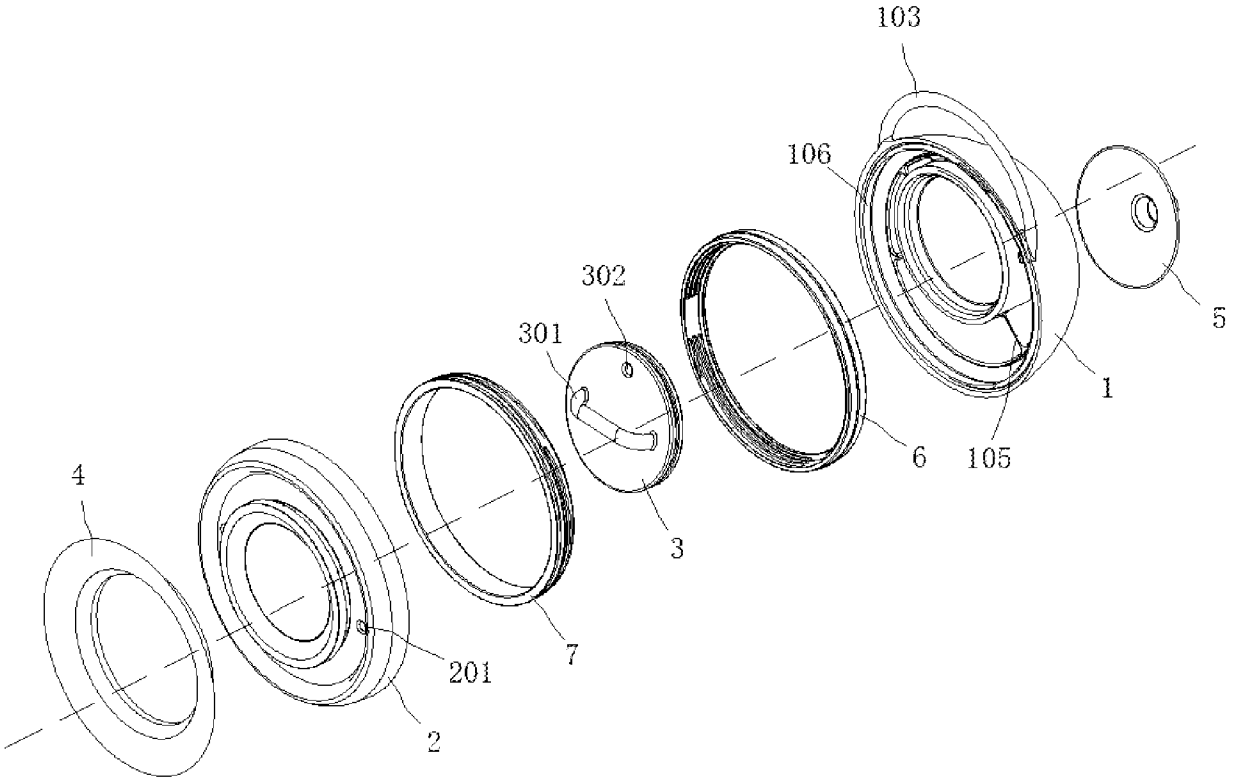
FIG. 1 is a perspective exploded view of a nursing bottle according to an embodiment of the present disclosure.

1 bottle body
101 containing cavity
102 storage bin
109 first opening
1021 scale
1022 . . . second opening
1023 . . . third buckle
103 second handle
104 nipple
1041 water outlet
105 reinforcing rib
106 first mounting groove
107 convex strip
108 retaining strip
110 retaining groove
2 bottle bottom
201 vent hole
202 second mounting groove
3 seal
301 first handle
302 one-way air valve
303 third slot
4 suction cup
5 protective cover
6 first fixing ring
7 second fixing ring
801 first buckle
802 first slot
803 second buckle
804 second slot

DETAILED DESCRIPTION

The embodiments of the present disclosure will be described in further detail below in conjunction with the accompanying drawings. Apparently, the described embodiments are only some embodiments of the present disclosure, not all embodiments. Based on the embodiments of the present disclosure, all other embodiments obtained by those skilled in the art without creative work shall fall within the protection scope of the present disclosure.

As shown in FIGS. 1 to 4 and 6, the present disclosure provides a nursing bottle, which includes a detachable body 1 and a bottle bottom 2. Both the bottle body 1 and the bottle bottom 2 are made of silica gel. The bottle body has an arc shape imitating a woman's breast, the outside of the bottle body 1 is provided with a nipple 104, and the nipple 104 is provided with a water outlet 1041. The bottle body 1 is provided with a containing cavity 101. The bottle body 1 is provided with a first opening 109, and the first opening is selectively blocked by the bottle bottom 2. A storage bin 102 for storing liquid is provided in the containing cavity 101, and the water outlet 1041 is in communication with the storage bin 102. A side of the storage bin 102 facing towards the bottle bottom 2 is provided with a second opening 1022. Reinforcing ribs 105 are provided between the cavity wall of the containing cavity 101 and the outer periphery of the storage bin 102. The bottle body 1 is configured to be an arc shape imitating a woman's breast, which enables infants to gradually adapt to the way of bottle feeding. Since the bottle body 1 is made of silica gel, and the hardness of the bottle body 1 is small, it is easy to deform the bottle during holding the bottle by hand. Since reinforcing ribs 105 are provided between the storage bin 102 and the containing cavity 101, when there is less liquid in the storage bin 102, the reinforcing rib 105 can provide support for the bottle body 1, so that the bottle body 1 is kept in an arc shape to avoid the rejection of infants and young children due to the deformation of the nursing bottle and it is convenient for feeders to feed infants and young children.

Silica gel has the advantages of high and low-temperature resistance and a wide range of temperature differences resistance. The lowest temperature resistance may reach minus 50° C. on average, and the highest temperature resistance may reach 300° C. on average. The silica gel has a rebound effect, skin-friendly texture, and is not easy to conduct heat in case of high temperature. The bottle body 1 is configured to be in the shape imitating a woman's breast, at the same time, the silica gel has the elasticity and the skin-friendly touch, which can weaken the recognition between the container and the breast in the process of contact, help infants adapt to the process from breastfeeding to bottle feeding, and improve the acceptance of different feeding manners.

In the embodiment, the maximum diameter of the bottle body 1 is 125 mm, the height of the bottle body 1 is 90 mm, and the volume of the storage bin 102 is 120 ml.

In the embodiment, the length of the nipple 104 is 25 mm, the end of the nipple 104 facing away from the bottle body 1 is wider, and the maximum width of the nipple 104 is 13 mm. The end of the nipple 104 facing towards the bottle body 1 is narrower, and the nipple 104 is waist-shaped as a whole. The area of the outer surface adjacent to the nipple 104 is provided with a plurality of areola-like convex points, and the plurality of convex points are arranged in circular ring around the nipple 104, and the height of the convex points is about 0.5 mm.

Specifically, the nursing bottle is provided with a protective cover 5. The protective cover 5 is detachably connected to the bottle body 1, and the protective cover 5 is arranged outside the nipple 104. The protective cover 5 is provided on the bottle body 1. When the nursing bottle is not in use, the protective cover 5 may cover outside the nipple 104 to prevent the nipple 104 from falling dust or being externally contaminated.

Figure 4:
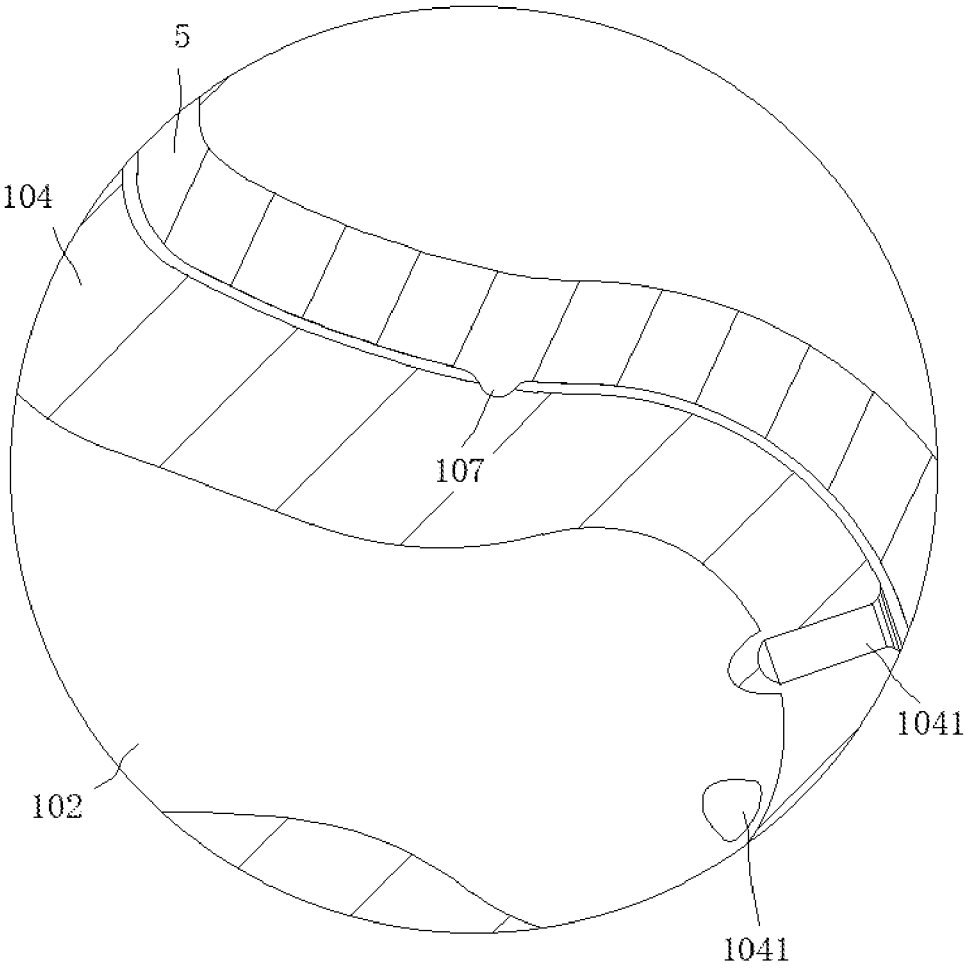
FIG. 4 is an enlarged view of A in FIG. 3.

Referring to FIG. 4, specifically, a ring shaped convex strip 107 is provided on a positon on the inner wall of the protective cover 5 adjacent to the nipple 104. When the protective cover 5 is connected to the bottle body 1, the nipple 104 can be tightly clamped by the convex strip 107. Since the nipple 104 is waist-shaped, the convex strip 107 is provided with a fixing position for the protective cover 5 by using the shape of the nipple 104, simplifying the structure of the protective cover 5, and reducing the processing difficulty.

In the embodiment, the bottle body 1 is made of silica gel with hardness of 5, and the bottle bottom 2 is made of silica gel with hardness of 60. During the nursing bottle is in use, infants and young children have less contact with the bottle bottom 2. Through configuring the hardness of the bottle bottom 2 greater than that of the bottle body 1, the bottle bottom 2 can provide support for the bottle body 1 to avoid deformation of the bottle body 1. Specifically, the outer surface of the bottle body 1 is smooth. During the nursing bottle is in use, the bottle body 1 is the area most contacted by infants and young children. The sense of touch of the bottle body 1 directly affects the eating conditions of the infants and young children. The outer surface of the bottle body 1 is configured to be smooth to enable the bottle body 1 to be similar to the morphology of a woman's breast so as to reduce in maximum extent the probability of the case where infants and young children refuse to eat due to the inadaptation to the nursing bottle.

Specifically, when the bottle body 1 is connected to the bottle bottom 2, The outer surface of the connection position between the bottle body 1 and the bottle bottom is flush, and the outer surface of the nursing bottle is smooth. The connection area between the bottle body 1 and the bottle bottom 2 is the part where infants and young children may touch during the nursing bottle is in use. The outer surface of the nursing bottle is configured to be smooth to enable the nursing bottle to be similar to the morphology of a woman's breast and to improve the overall sense of touch of the nursing bottle.

In an embodiment, a second handle 103 is provided on the bottle body 1. When the nursing bottle is in use, the feeder may hold the second handle 103 and then feed the infants and young children, which can reduce the contact with the bottle body 1 and prevent the bottle body 1 from being squeezed and deformed.

In the embodiment, a plurality of reinforcing ribs 105 are provided between the containing cavity 101 and the storage bin 102 at intervals. The plurality of reinforcing ribs 105 at intervals can provide support for the bottle body 1 from different directions so that the bottle body 1 can still maintain an arc shape imitating a woman's breast during the nursing bottle is in use.

In the embodiment, the number of reinforcing ribs 105 is four, and the four reinforcing ribs 105 are symmetrically distributed about the axis of the bottle body 1. The thickness of each reinforcing rib 105 gradually decreases in an outside-in direction, and the minimum thickness of the reinforcing rib 105 is 2 mm. The length of the reinforcing rib 105 can be flexibly configured according to the distance between the cavity wall of the containing cavity 101 and the outer periphery of the storage bin 102. In the embodiment, the minimum length of the reinforcing rib 105 is 10 mm and the maximum length of the reinforcing rib 105 is 25 mm.

Specifically, the inner wall of the storage bin 102 is smooth. Since the liquid is stored in the storage bin 102, the cleanliness of the storage bin 102 directly affects the health of infants and young children. The storage bin 102 with a smooth inner wall can avoid clean dead corners in the storage bin 102 and reduce the difficulty of cleaning the nursing bottle.

Specifically, the cross-sectional size of the storage bin 102 is reduced in the direction from the second opening 1022 to the water outlet 1041. In the embodiment, the maximum outer diameter of the storage bin 102 is 59 mm. When the nursing bottle is in use, the storage bin 102 is inclined downward, and the end of the storage bin 102 provided with the water outlet 1041 is lower than the end of the storage bin 102 facing towards the first opening 109. The storage bin 102 is at an angle $\alpha$ to the horizontal. When the nursing bottle is in use, the storage bin 102 is tilted downward as a whole, and the liquid in the storage bin 102 can be concentrated near the water outlet 1041 to improve the liquid outflow effect of the nursing bottle.

Specifically, in the embodiment, the a angle is in the range of 8° to 25°.

In an embodiment, the inner wall of the storage bin 102 is provided with a scale 1021. Since the shape of the storage bin 102 is irregular, by setting the scale 1021, it is convenient for the feeder to brew milk powder and the convenience of using the nursing bottle is improved.

In an embodiment, the nipple 104 is provided with three water outlets 1041, and the connection lines of the three water outlets 1041 form an equilateral triangle. The provision of the three water outlets 1041 can improve the liquid outflow of the nursing bottle and enable the use feeling of the nursing bottle to be similar to that of the woman's breast.

In an embodiment, the bottle bottom 2 may simultaneously block the first opening 109 of the bottle body 1 and the second opening 1022 of the storage bin 102. At this time, the first opening 109 may be flush with the second opening 1022, so that the thickness of the bottle bottom 2 may be thinned. Of course, the second opening 1022 may also be slightly lower than the first opening 109, that is, the second opening 1022 is located in the containing cavity 101. At this time, the thickness of the area where the bottle bottom 2 blocks the second opening 1011 needs to be greater than that of other areas.

In the embodiment, the storage bin 102 is provided with a seal 3 that blocks the second opening 1022, and the seal 3 is detachably connected to the storage bin 102. The first opening 109 is blocked by the bottle bottom 2, and the second opening 1022 is blocked by the seal 3, which can improve the sealing effect of the storage bin 102. Since the containing cavity 101 is provided with complex structures such as reinforcing ribs 105, the seal 3 can prevent the liquid in the storage bin 102 from flowing into the containing cavity 101, thereby reducing the difficulty of cleaning the nursing bottle.

Figure 3:
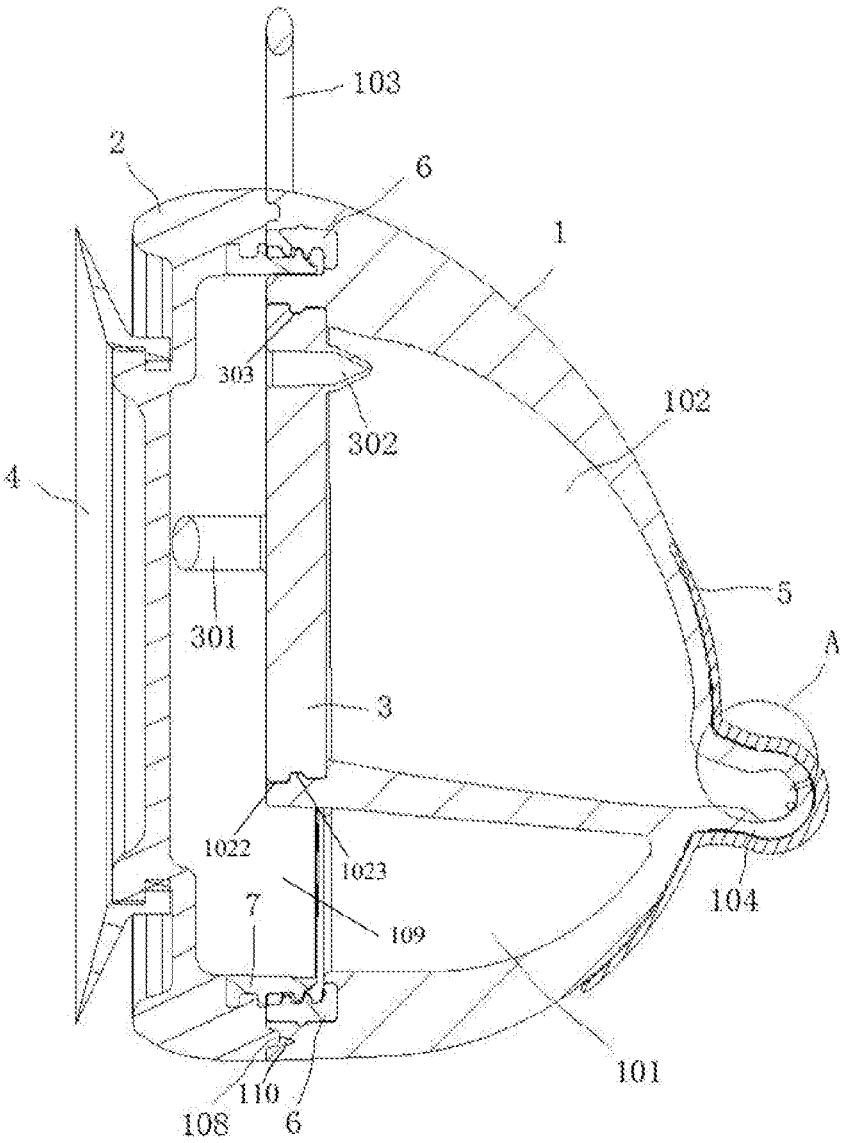
FIG. 3 is a cross-sectional view of a nursing bottle according to an embodiment of the present disclosure.

In an embodiment, as shown in FIG. 3, the seal 3 is made of silica gel, the seal 3 is cylindrical. The diameter of the seal is 61 mm and the height of the seal is 29 mm. The periphery of the second opening is provided with a third buckle protruding in a ring shape, and the outer periphery of the seal 3 is provided with a third slot 303. Since the seal 3 and the bottle body 1 are made of silica gel, the width of the third buckle may be slightly larger than the width of the third slot. In the embodiment, the width of the third slot is 2 mm. The depth of the third slot is 2 mm. When the third buckle is inserted into the third groove, the seal 3 can have a good sealing effect, so that the liquid can only flow out of the storage bin 102 from the water outlet 1041. Of course, in other embodiments, the seal 3 may be connected to the bottle body 1 in a threaded manner.

In an embodiment, as shown in FIGS. 1 and 3, a one-way air valve 302 is provided on the seal 3, and at least one vent hole 201 is provided on the the bottle bottom 2. The diameter of the vent hole 201 is 4 mm and the depth of the vent hole 201 is 28 mm. When the internal air pressure of the storage bin 102 is lower than the external air pressure, The one-way air valve 302 is opened, and when the internal air pressure of the storage bin 102 is equal to or higher than the external air pressure, the one-way air valve 302 is closed. When the nursing bottle is in use, air enters the containing cavity 101 from the vent hole 201, and then enters the storage bin 102 from the one-way air valve 302, such that the air pressure in the storage bin 102 is increased. Since the storage bin 102 is sealed by the seal 3, the one-way air valve 302 is provided to improve the liquid outflow effect of the water outlet 1041 and avoid the influence of the air pressure in the bottle on the feeding of infants.

Specifically, as shown in FIG. 1, a first handle 301 is provided on the side of the seal 3 facing away from the storage bin 102. The first handle 301 may provide a force applying position for installation and disassembly of the seal 3, and reduce the difficulty of installation and disassembly of the seal 3.

In an embodiment, the cross section of the first handle 301 is cylindrical. The diameter of the first handle 301 is 11 mm and the height of the first handle 301 is 10 mm. In the embodiment, the first handle 301 is C-shaped. Two ends of the first handle 301 are connected to the sealing 3. The cylindrical first handle 301 needs to rely on the friction between the fingers and the first handle 301 to disassemble the seal 3. The C-shaped first handle 301 is provided for the fingers being inserted between the handle 301 and the seal 3, which reduces the force required to disassemble the seal 3 and reduces the difficulty of disassembling the seal 3.

Figure 5:
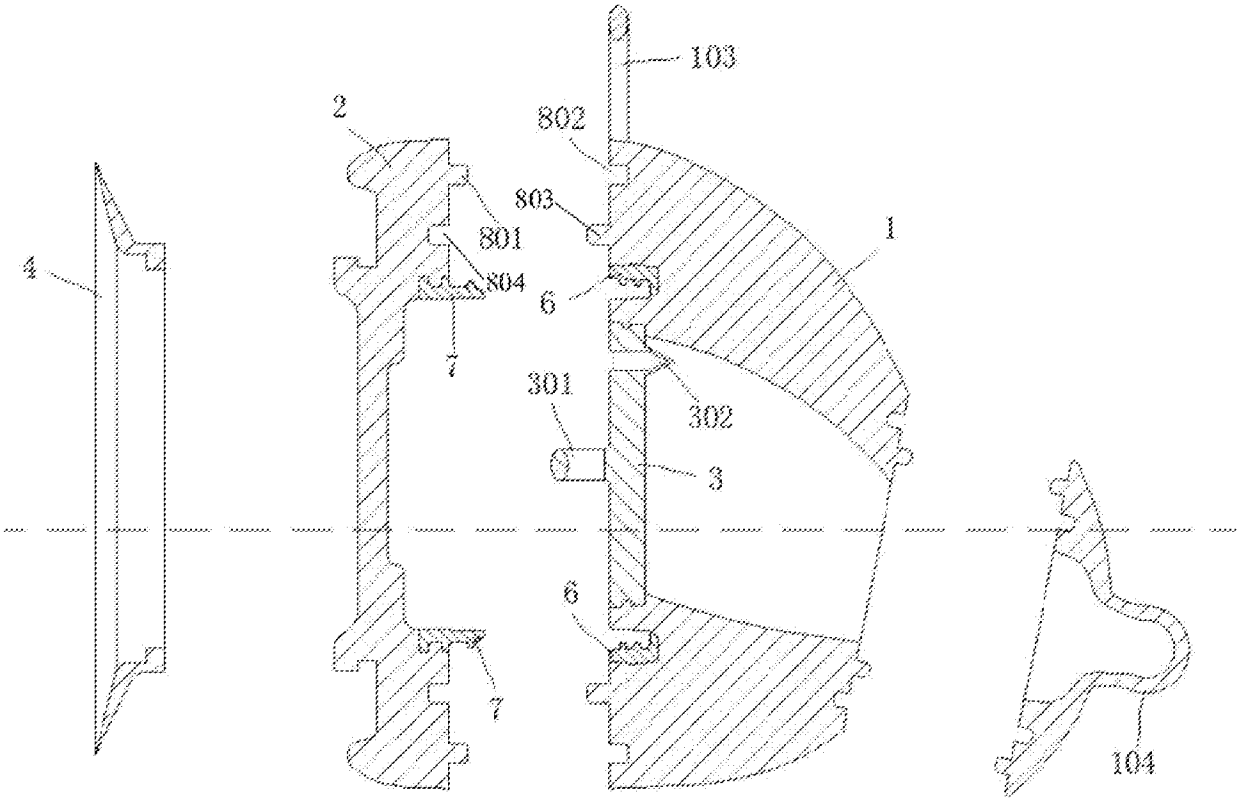
FIG. 5 is an anatomical view of a nursing bottle according to another embodiment of the present disclosure.

Specifically, as shown in FIG. 5, the bottle body 1 is connected to the bottle bottom 2 by a first fixing ring 6 and a second fixing ring 7. The first fixing ring 6 is connected to the bottle body 1, the second fixing ring 7 is connected to the bottle bottom 2, and the first fixing ring 6 is detachably connected to the second fixing ring 7. The hardness of each of the first fixing ring 6 and the second fixing ring 7 is greater than the hardness of the bottle body 1 and the bottle bottom 2. When the bottle body 1 is connected to the bottle bottom 2, the first fixing ring 6 and a second fixing ring 7 are hidden inside the nursing bottle. Since the hardness of the bottle body 1 and the bottle bottom 2 is relatively low, the first fixing ring 6 and the second fixing ring 7 with greater hardness can improve the connection strength between the bottle body 1 and the bottle bottom 2.

In the embodiment, the first fixing ring 6 is connected to the second fixing ring 7 in a threaded manner, and the materials of the first fixing ring 6 and the second fixing ring 7 are PP (polypropylene). PP (polypropylene) is a colorless, odorless, non-toxic, translucent solid substance, is a thermoplastic synthetic resin with excellent performance, is a colorless and translucent thermoplastic lightweight general-purpose plastic with chemical resistance, heat resistance, electrical insulation, high-strength mechanical properties, and good processing performance of high wear-resistant.

Figure 2:
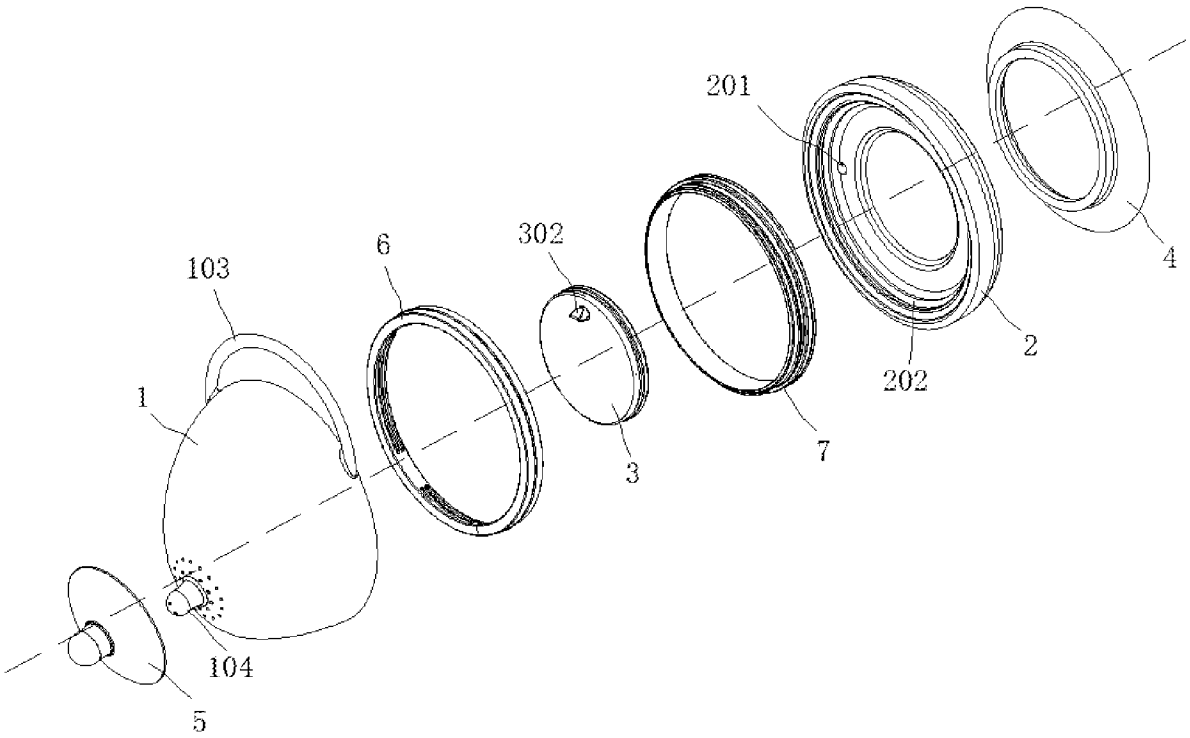
FIG. 2 is another perspective exploded view of a nursing bottle according to an embodiment of the present disclosure.
Figure 6:
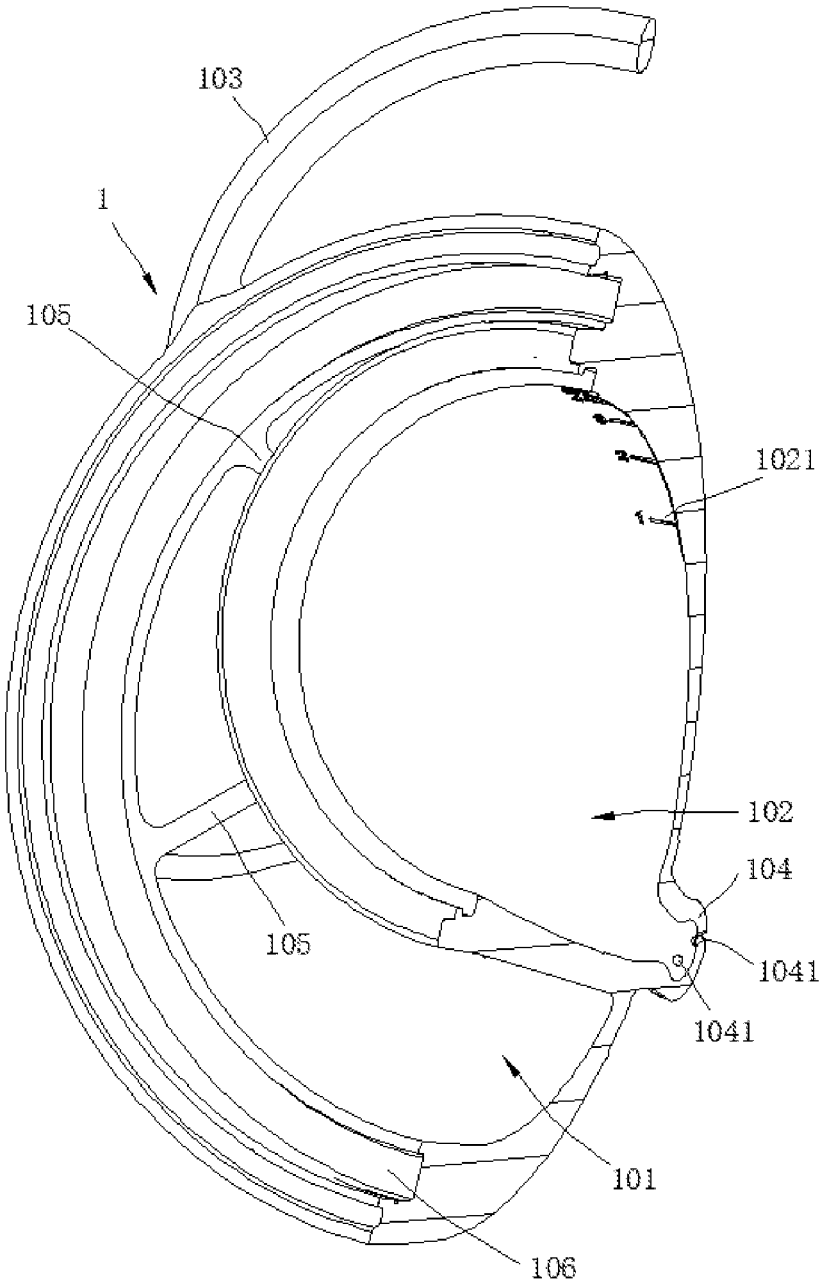
FIG. 6 is a cross-sectional view of a bottle body according to an embodiment of the present disclosure.

Specifically, as shown in FIGS. 2 and 6, a first mounting groove 106 is provided on the first opening 109. The outer diameter of the first mounting groove 106 is 105 mm, the inner diameter of the first mounting groove 106 is 99 mm, the width of the first mounting groove 106 is 3 mm, and the depth of the first mounting groove 106 is 10 mm. The first fixing ring 6 is provided in the first mounting groove 106, the outer diameter of the first fixing ring 6 is 114 mm, the inner diameter of the first fixing ring 6 is 104 mm, and the thickness of the first fixing ring 6 is 5 mm. The threaded part of the first fixing ring 6 is provided with trapezoidal internal threads. Two-turn thread is provided, the width of each turn is 3 mm, the depth of each turn is 1 mm, and the thickness of each turn is 1 mm. The bottle bottom 2 is provided with a second mounting groove 202. The outer diameter of the second mounting groove 202 is 110 mm, the inner diameter of the second mounting groove 202 is 86 mm, the width of the second mounting groove 202 is 12 mm, and the depth of the second mounting groove 202 is 18 mm. The second fixing ring 7 is provided in the second mounting groove 202. The outer diameter of the fixing ring 7 is 117 mm, the inner diameter of the fixing ring 7 is 105 mm, and the thickness of the fixing ring 7 is 6 mm. The threaded part of the second fixing ring 7 is a trapezoidal external thread. The thread is provided with 2.8 turns. The interval width of each turn is 2 mm, the depth of each turn is 1 mm, and the thickness of each turn is 1 mm. The size of the first fixing ring 6 is larger than that of the first mounting groove 106, and the size of the second fixing ring 7 is larger than that of the second mounting groove 202. At this time, the first fixing ring 6 can be fixed to the bottle body 1, and the second fixing ring 7 can be fixed to the bottle bottom 2, which improves the connection strength between the components of the nursing bottle. The first fixing ring is connected to the second fixing ring in a threaded manner, which can maximize the connection strength between the bottle bottom 2 and the bottle body 1, and can also prevent liquid from flowing out of the nursing bottle, thereby improving the leak-proof effect of the nursing bottle.

Specifically, the first fixing ring 6 is fixed to the bottle body 1 with glue, and the second fixing ring 7 may also be fixed to the bottle bottom 2 with glue. Adhesive can further improve the stability of the connection between the first fixing ring 6 and the bottle body 1 and the stability of the connection between the second fixing ring 7 and the bottle bottom 2, and prevent the first fixing ring 6 and the second fixing ring 7 from detaching from the bottle body 1 or the bottle bottom 2.

Referring to FIG. 3, one of the bottle body 1 and the bottle bottom 2 is provided with a retaining strip 108 protruding in circle shaped, and another of the bottle body 1 and the bottle bottom 2 is correspondingly provided with a retaining groove 110. In the embodiment, the retaining strips 108 are provided on the bottle bottom 2. The retaining groove 110 is arranged in the bottle body 1. When the bottle body 1 is connected to the bottle bottom 2, the retaining strip 108 is inserted into the retaining groove 110, and the combination of the retaining strip 108 and the retaining groove can play a secondary sealing effect for the nursing bottle and improve the sealing performance of the nursing bottle.

Referring to FIG. 5, in other embodiments, the bottle body 1 may be connected to the bottle bottom 2 in a snap-fit manner, and the first fixing ring 6 may be connected to the second fixing ring 7 in a snap-fit manner. The first fixing ring 6 is connected to the second fixing ring 7 by at least two sets of first buckling components. Each set of the first buckling components includes a first buckle 801 and a first slot 802. The first fixing ring 6 is provided with at least one first buckle 801 and at least one first slot 802 at intervals and the second fixing ring 7 is correspondingly provided with at least one first slot 802 and at least one second buckle 803 respectively. The lengths of the first buckle 801 and the first slot 802 extend along the first direction. At least two sets of second buckling components are further provided between the bottle body 1 and the bottle bottom 2. Each set of the second buckling components includes a second buckle 803 and a second slot 804. The bottle body 1 is at least provided with a second buckle 803 and a second groove at intervals. The bottle bottom 2 is correspondingly provided with at least one second slot 804 and at least one second buckle 803 respectively, and the lengths of the second buckle 803 and the second buckle 803 extend along a second direction. The first direction is a vertical direction and the second direction is horizontal. With the snap-fit connection manner, when the nursing bottle is in use, the fixing between the bottle body 1 and the bottle bottom 2 can be completed only by snapping the bottle bottom 2 and the bottle body 1 together, which reduces the difficulty of connecting the bottle body 1 and the bottle bottom 2.

Referring to FIG. 5, the nipple 104 is detachably connected to the bottle body 1. In the embodiment, the bottle body 1 is connected to the nipple 104 in a snap-fit manner. When the nipple 104 is connected to the bottle body 1, the outer surface of the bottle is smooth. A detachable nipple 104 is provided to facilitate the cleaning of the nipple 104 after use. Since there is more contact between the nipple 104 and the mouths of infants and young children, the nipple 104 has a certain lifespan, and thus a detachable nipple 104 is provided. When the bottle has been used for a certain period, only the nipple 104 needs to be replaced separately, which reduces the use cost of the nursing bottle.

Specifically, referring to FIG. 3, a suction cup 4 is provided on the side of the bottle bottom 2 facing away from the bottle body 1, and the suction cup 4 is detachably connected to the bottle bottom 2. In the embodiment, the suction cup 4 is connected to the bottle bottom 2 by a buckle. Since infants and young children need a longer feeding time, the nursing bottle may be adsorbed on a fixed position by the suction cup 4 during use, and the feeder does not need to maintain a fixed feeding posture for a long time, reducing the fatigue of the feeder when feeding the infant.

The invention claimed is:

1. A nursing bottle, comprising:

a bottle body and a bottle bottom, wherein the bottle body is detachably connected to the bottle bottom, both the bottle body and the bottle bottom are made of silica gel, and the bottle body has an arc shape imitating a woman's breast;

an outer side of the bottle body is provided with a nipple, and the nipple is provided with a water outlet;

the bottle body is provided with a first opening, and the first opening is selectively blocked by the bottle bottom;

a containing cavity is provided in the bottle body, a storage bin for storing liquid is provided in the containing cavity, and the water outlet is in communication with the storage bin;

a side of the storage bin facing towards the bottle bottom is provided with a second opening;

reinforcing ribs are provided between a cavity wall of the containing cavity and an outer periphery of the storage bin.

2. The nursing bottle according to claim 1, wherein an outer surface of the bottle body is smooth.

3. The nursing bottle according to claim 2, wherein an outer surface of a connection position of the bottle body and the bottle bottom is flush, in the case where the bottle body is connected to the bottle bottom.

4. The nursing bottle according to claim 1, wherein a cross-sectional size of the storage bin gradually decreases in a direction from the second opening towards the water outlet;

the storage bin is inclined downward in the case where the nursing bottle is in use, one end of the storage bin provided with the water outlet is lower than another end of the storage bin facing towards the first opening, and the storage bin is at an angle $\alpha$ to a horizontal.

5. The nursing bottle according to claim 4, wherein the angle $\alpha$ is in a range of 8° to 25°.

6. The nursing bottle according to claim 1, wherein an inner wall of the storage bin is smooth.

7. The nursing bottle according to claim 6, wherein the storage bin is provided with a seal that blocks the second opening, and the seal is detachably connected to the storage bin.

8. The nursing bottle according to claim 7, wherein a first handle is provided on a side of the seal facing towards the bottle bottom.

9. The nursing bottle according to claim 1, wherein a second handle is provided on the bottle body.

10. The nursing bottle according to claim 1, wherein a suction cup is provided on a side of the bottle bottom facing away from the bottle body, and the suction cup is detachably connected to the bottle bottom.

11. The nursing bottle according to claim 1, further comprising a protective cover, wherein the protective cover is detachably connected to the bottle body, and the protective cover is provided outer side of the nipple.

12. The nursing bottle according to claim 11, wherein a ring shaped convex strip is provided on a position on an inner wall of the protective cover adjacent to the nipple, the convex strip is capable of clamping the nipple tightly in case where the protective cover is connected to the bottle body.

13. The nursing bottle according to claim 1, wherein the nipple is detachably connected to the bottle body, and an outer surface of the nursing bottle is smooth in case where the nipple is connected to the bottle body.

14. The nursing bottle according to any one of claim 1, further comprising a first fixing ring and a second fixing ring cooperated with each other, wherein the bottle body is connected to the bottle bottom by the first fixing ring and the second fixing ring;

the first fixing ring is connected to the first opening of the bottle body, and the second fixing ring is connected to the bottle bottom;

the first fixing ring is detachably connected to the second fixing ring, and the hardness of the first fixing ring and the second fixing ring is greater than that of the bottle body and the bottle bottom;

the first fixing ring and the second fixing ring are hidden inside the nursing bottle in a case where the bottle body is connected to the bottle bottom.

15. The nursing bottle according to claim 14, wherein the first opening is provided with a first installation groove, and the first fixing ring is provided in the first mounting groove; the bottle bottom is provided with a second mounting groove, and the second fixing ring is provided in the second mounting groove.

16. The nursing bottle according to claim 15, wherein at least one of the following configurations is adopted:

the first fixing ring is fixed to the bottle body with glue; or the second fixing ring is fixed to the bottle bottom with glue.

17. The nursing bottle according to claim 14, wherein the first fixing ring is connected to the second fixing ring by threads, one of the first fixing ring and the second fixing ring is provided with an external thread, and another of the first fixing ring and the second fixing ring is provided with an internal thread matched with the external thread.

18. The nursing bottle according to claim 14, wherein both a connection between the bottle body and the bottle bottom and a connection between the first fixing ring and the second fixing ring are in a snap-fit manner.

19. The nursing bottle according to claim 14, wherein the first fixing ring is connected to the second fixing ring by at least two sets of first buckling components, each set of the first buckling components comprises a first buckle and a first slot;

the first fixing ring is provided with at least one first buckle and at least one first slot at intervals among the at least two sets of first buckling components, the second fixing ring is correspondingly provided with at least one first slot and at least one first buckle respectively among the at least two sets of first buckling components, and the lengths of the first buckle and the first slot are configured to extend along a first direction;

at least two sets of second buckling components are provided between the bottle body and the bottle bottom, each set of the second buckling components comprises a second buckle and a second slot, the bottle body is provided with at least one second buckle and at least one second slot at intervals among the at least two sets of second buckling components, the bottle bottom is correspondingly provided with at least one second slot and at least one second buckle among the at least two sets of second buckling components, and the lengths of the second buckle and the second slot are along a second direction;

the first direction is at an angle to the second direction.

* * * * *